US010116104B2

(12) United States Patent
Ishida et al.

(10) Patent No.: US 10,116,104 B2
(45) Date of Patent: Oct. 30, 2018

(54) ELECTRICAL CONNECTOR HAVING A SUB-HOUSING WITH A SHORT CIRCUIT TERMINAL

(71) Applicant: Yazaki Corporation, Minato-ku, Tokyo (JP)

(72) Inventors: Takuya Ishida, Utsunomiya (JP); Tomoyuki Miyakawa, Utsunomiya (JP); Tsuyoshi Harada, Sagamihara (JP); Shinichi Ikemoto, Sagamihara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/703,445

(22) Filed: Sep. 13, 2017

(65) Prior Publication Data

US 2018/0076577 A1 Mar. 15, 2018

(30) Foreign Application Priority Data

Sep. 13, 2016 (JP) ..... 2016-178790

(51) Int. Cl.
*H01R 29/00* (2006.01)
*H01R 13/703* (2006.01)
(Continued)

(52) U.S. Cl.
CPC ..... *H01R 13/7031* (2013.01); *H01R 13/506* (2013.01); *H01R 13/5202* (2013.01)

(58) Field of Classification Search
CPC ..... H01R 13/7031; H01R 13/7039; H01R 13/70; H01R 13/506
(Continued)

(56) References Cited

U.S. PATENT DOCUMENTS 5,803,756 A * 9/1998 Furutani ..... H01R 13/7032 200/51.1
5,944,547 A * 8/1999 Golab ..... H01R 13/7032 200/51.1
(Continued)

FOREIGN PATENT DOCUMENTS

JP 2002-305057 A 10/2002
JP 2012-064414 A 3/2012

OTHER PUBLICATIONS

Aug. 7, 2018—(JP) Notification of Reasons for Refusal—App 2016-178790.

*Primary Examiner* — Hae Moon Hyeon
(74) *Attorney, Agent, or Firm* — Banner & Witcoff, Ltd.

(57) ABSTRACT

A connector includes a connector housing that includes a plurality of terminal accommodation chambers, a terminal that is accommodated in the terminal accommodation chamber, a retainer portion that holds the accommodated terminal in the terminal accommodation chamber, a short circuit terminal that makes at least two of the accommodated terminals be in a short-circuited state by coming into contact with the two accommodated terminals, and a sub-housing on which the short circuit terminal is mounted. The connector housing includes a fitting portion to which the sub-housing is fitted in a direction orthogonal to a fitting direction of the connector housing to a counterpart connector housing, and the retainer portion is formed at a position of holding the terminal and the short circuit terminal is mounted at a position at which the short circuit terminal comes into contact with the terminals.

4 Claims, 8 Drawing Sheets

(51) Int. Cl.
*H01R 13/506* (2006.01)
*H01R 13/52* (2006.01)

(58) Field of Classification Search
USPC ..... 439/188, 752
See application file for complete search history.

(56) References Cited

U.S. PATENT DOCUMENTS

| | | | | |
|---|---|---|---|---|
| 6,186,805 | B1 * | 2/2001 | Krishnaswamy .. | H01R 13/7032 200/51.1 |
| 6,827,596 | B2 * | 12/2004 | Hori ..... | H01R 13/6275 439/188 |
| 2003/0060078 | A1 * | 3/2003 | Kashiyama ..... | H01R 13/641 439/489 |
| 2012/0225574 | A1 | 9/2012 | Nakamura | |
| 2013/0040488 | A1 | 2/2013 | Nakamura | |
| 2018/0034180 | A1 * | 2/2018 | Sekino ..... | H01R 13/28 |
| 2018/0102613 | A1 * | 4/2018 | Ishida ..... | H01R 13/7032 |

* cited by examiner

ELECTRICAL CONNECTOR HAVING A SUB-HOUSING WITH A SHORT CIRCUIT TERMINAL

CROSS REFERENCE TO RELATED APPLICATION

This application is based on Japanese Patent Application No. 2016-178790 filed on Sep. 13, 2016, the contents of which are incorporated herein by reference.

BACKGROUND OF THE INVENTION

1. Technical Field

The present invention relates to a connector which is used in connection of a wire harness for a vehicle or the like.

2. Background Art

In JP-A-2002-305057, as a connector for connecting electric wires which are routed in a vehicle to each other, there is a connector which can sense a coupled state between the connectors. In FIG. 10, in the connector which is used in a wiring system of an air bag or the like of an automobile, a structure of a connector 500 of the related art which can electrically sense the coupled state between a male connector 510 and a female connector 520 is described as an example.

The male connector 510 includes a male connector housing (hereinafter, described as a male housing 511), and a pair of male terminals 512 (only one of them is illustrated, the same hereinafter). On an inner side of the male housing 511, a connector fitting chamber 513 into which the female connector 520 is inserted is formed. In the connector fitting chamber 513, a partition wall 514 interposed between the pair of male terminals 512, and an insulating piece 515 formed to be integrated with the partition wall 514 are formed. The male terminal 512 is disposed while a tip end thereof protrudes to the inside of the connector fitting chamber 513. An electric wire 516 is pressed to a rear end side of the male terminal 512.

The female connector 520 includes a female connector housing (hereinafter, described as a female housing 521), a pair of female terminals 522 (only one of them is illustrated, the same hereinafter), and a short circuit terminal 523 which short-circuits the pair of female terminals 522. In the short circuit terminal 523, an elastic arm portion 524 is formed. An electric wire 525 is pressed to the rear end side of the female terminal 522.

In a state where the male connector 510 and the female connector 520 are not coupled to each other, the elastic arm portion 524 of the short circuit terminal 523 comes into contact with the female terminal 522 of the female connector 520, and the pair of female terminals 522 are short-circuited. From this state, when the coupling between the male connector 510 and the female connector 520 is started, the male terminal 512 is inserted into the female terminal 522. At this time, the insulating piece 515 moves in a coupling direction while being in slidable contact with the elastic arm portion 524 of the short circuit terminal 523. When the coupling between the male connector 510 and the female connector 520 is completed, an electric connection between the male terminal 512 and the female terminal 522 is completed. At the same time, as illustrated in FIG. 11, the insulating piece 515 pushes up the elastic arm portion 524 and releases the short circuit between the female terminals 522. Therefore, by sensing whether or not the short circuit between the pair of female terminals 522 is released, it is possible to sense whether or not the male connector 510 and the female connector 520 are normally coupled to each other.

In addition, by short-circuiting the female terminals 522, it is also possible to prevent a malfunction of an inflator for an air bag caused by static electricity.

As described above, the connector 500 of the related art can sense whether or not the male connector 510 and the female connector 520 are normally coupled to each other by sensing whether or not the short circuit between the female terminals 522 and 522 by the short circuit terminal 523 is released.

However, the connector 500 of the related art has a structure in which the short circuit terminal 523 is assembled in the female housing 521 from an opening portion 521*a* on the front end side of the female housing 521.

Therefore, in the connector 500 of the related art, it is necessary to select a dimension of the opening portion 521*a* on the front end side of the female housing 521 in accordance with a dimension of the short circuit terminal 523. As a result, the dimension of the opening portion 521*a* or the dimension of the female housing 521 is likely to increase. In addition, when the dimension of the opening portion 521*a* is restricted, there is a case where the existing short circuit terminal 523 cannot be assembled to the female housing 521.

The invention has been made in consideration of the above-described problem, and an object thereof is to provide a connector which can set a dimension of an opening portion of a front end of a connector housing to be smaller than that of the related art.

SUMMARY OF THE INVENTION

In order to achieve the above-described object, a connector according to the invention is characterized as following (1) to (4).

(1) According to an aspect of the invention, a connector includes a connector housing that includes a plurality of terminal accommodation chambers, a terminal that is accommodated in the terminal accommodation chamber, a retainer portion that holds the accommodated terminal in the terminal accommodation chamber, a short circuit terminal that makes at least two of the accommodated terminals be in a short-circuited state by coming into contact with the two accommodated terminals, and a sub-housing on which the short circuit terminal is mounted. Te connector housing includes a fitting portion which is open to the terminal accommodation chamber and to which the sub-housing is fitted in a direction orthogonal to a fitting direction of the connector housing to a counterpart connector housing, and in the sub-housing, in a state where the sub-housing is fitted to the connector housing, the retainer portion is formed at a position of holding the terminal and the short circuit terminal is mounted at a position at which the short circuit terminal comes into contact with at least two of the terminals.

According to the connector having the above-described configuration (1), in a state where the short circuit terminal is mounted on the retainer portion of the sub-housing, by allowing the sub-housing to be fitted to the fitting portion of the connector housing, it is possible to mount the short circuit terminal at a position at which the short circuit terminal comes into contact with at least two of the terminals. The sub-housing is assembled to the connector housing from the direction orthogonal to the fitting direction between the connector housing and the counterpart connector housing.

In this manner, in a state where the short circuit terminal is mounted on the sub-housing, by employing a configuration in which the sub-housing is assembled to the connector housing from the direction orthogonal to the fitting direction between the connector housing and the counterpart connector housing, it is possible to set the dimension of the opening portion on the front end side of the connector housing to be smaller compared to the connector of the related art in which the short circuit terminal is mounted from the opening portion on the front end side of the connector housing. In other words, even under the circumstance in which the dimension of the opening portion is restricted, it is possible to mount the existing short circuit terminal on the connector housing. Therefore, it becomes possible to use the existing short circuit terminal in various connectors.

(2) In the connector (1), wherein, in the counterpart connector housing, in a state of being fitted to the connector housing, a short circuit releasing member which releases the short-circuited state by coming into contact with the short circuit terminal and deforming the short circuit terminal is formed.

According to the connector having the above-described configuration (2), in the process of allowing the connector housing and the counterpart connector housing to be fitted to each other, the short circuit releasing member comes into contact with the short circuit terminal and deforms the short circuit terminal, the coupling of the connectors is completed, and at the same time, the short-circuited state between the terminals is released. Therefore, by sensing whether or not the short-circuited state between the terminals is released, it is possible to sense whether or not the connectors are normally coupled to each other.

(3) In the connector (1) or (2), the sub-housing includes a sealing member which tightly adheres to an inner wall of the fitting portion in a state of being mounted on an outer circumference of the sub-housing and fitted to the fitting portion.

According to the connector having the above-described configuration (3), by allowing the sub-housing to be fitted to the fitting portion, the inside of the fitting portion is sealed. Therefore, it is possible to prevent infiltration of moisture into the plurality of terminal accommodation chambers from the fitting portion.

(4) In one of the connectors (1) to (3), the retainer portion and the terminal respectively include a locking portion, and in a state where the sub-housing is fitted to the connector housing, the locking portion of the retainer portion and the locking portion of the terminal are locked to each other.

According to the connector having the above-described configuration (4), since the terminal is held by the sub-housing fitted to the fitting portion of the connector housing, it is not necessary to provide a holding portion having a complicated structure for holding the terminal in the connector housing. Accordingly, it is possible to simplify the structure of the connector housing.

According to the invention, it is possible to provide a connector which can set the dimension of the opening portion of the front end of the connector housing to be smaller than that of the related art.

Above, the invention was briefly described. Furthermore, by thoroughly reading the aspects (hereinafter, referred to as "embodiments") for realizing the invention which will be described hereinafter with reference to the attached drawings, specific contents of the invention will become more apparent.

DETAILED DESCRIPTION OF EMBODIMENTS

Specific embodiments related to the invention will be described hereinafter with reference to the drawings.

First Embodiments

First, a connector 1 in a first embodiment of the invention will be described.

Figure 1:
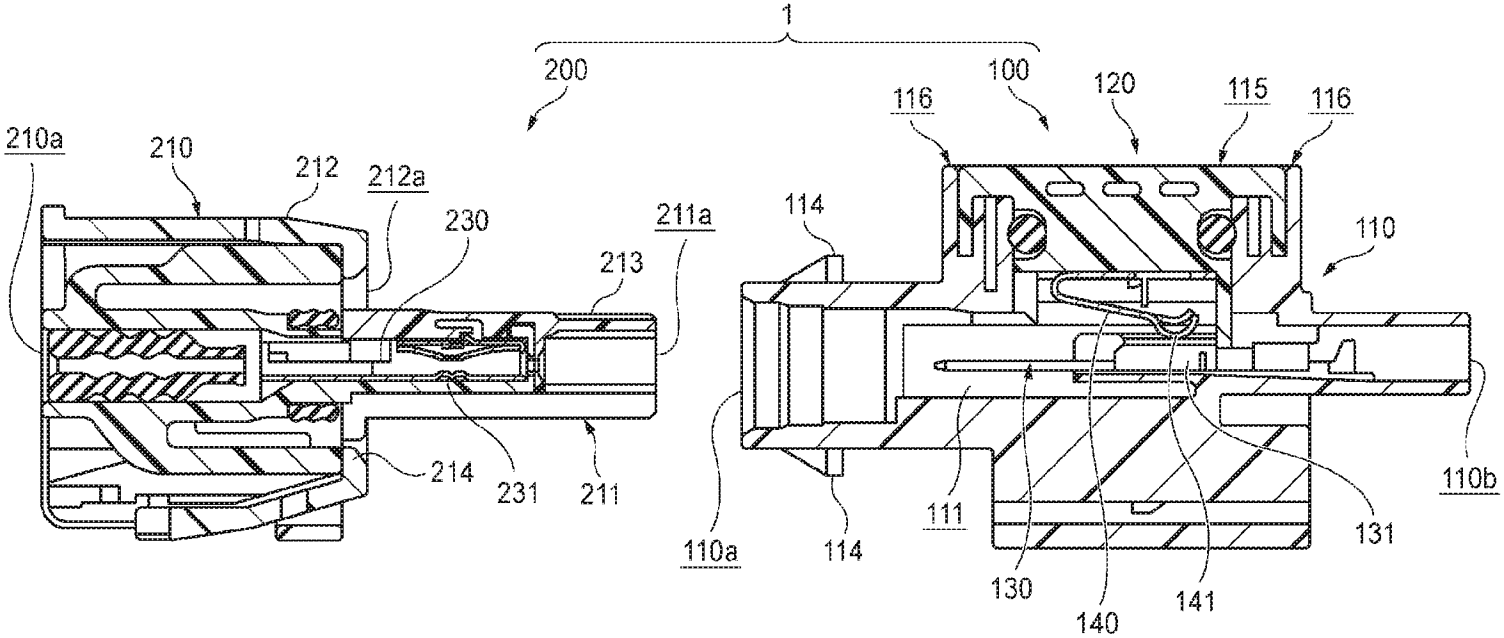
FIG. 1 is a sectional view illustrating a non-coupled state of connectors according to a first embodiment of the invention.

As illustrated in FIG. 1, the connector 1 of the first embodiment is configured of a male connector 100 and a female connector 200 which can be fitted to each other.

The male connector 100 includes a male housing 110 made of a synthetic resin and a sub-housing 120 made of a synthetic resin.

The male housing 110 includes an opening portion 110*a* and an opening portion 110*b* respectively on a front end side and on a rear end side. An insertion portion 211 of the female connector 200 is inserted into the opening portion 110*a* on the front end side. A plurality of locking projections 114 which are engaged with the female connector 200 are provided on an outer surface in the vicinity of the front end of the male housing 110.

In the male housing 110, a plurality of terminal accommodation chambers 111 (only one of the terminal accommodation chambers is illustrated, the same hereinafter) are formed. In each of the terminal accommodation chambers 111, male terminals 130 (only one of the male terminals is illustrated, the same hereinafter) are accommodated one by one. An electric wire which is not illustrated is pressed to each of the male terminals 130. The male terminal 130 is mounted to the inside of the terminal accommodation chamber 111 from the opening portion 110*b* on the rear end side in a state where the electric wire is pressed. In a center portion in a longitudinal direction of the male terminal 130, terminal side locking portions 131 which are at front edges in a connector coupling direction of recessed portions formed in both side portions, are provided.

In the male housing 110, a plurality (two in the example) of short circuit terminals 140 are accommodated. The short circuit terminal 140 is provided to be adjacent to the plurality of male terminals 130. The short circuit terminal 140 makes at least two of the terminals be in a short-circuited state by coming into contact with the two male terminals 130. In each of the short circuit terminals 140, an elastic arm portion 141 which is in contact with the terminal is formed.

The male housing 110 includes a tubular fitting portion 115 to which the sub-housing 120 is fitted, and the inside of the fitting portion 115 communicates with the plurality of terminal accommodation chambers 111. The sub-housing 120 is fitted to the fitting portion 115 in a direction orthogonal to a fitting direction between the male connector 100 and the female connector 200. At front and rear parts of the fitting portion 115 of the male housing 110, a pair of locking grooves 116 are respectively provided.

Figure 2:
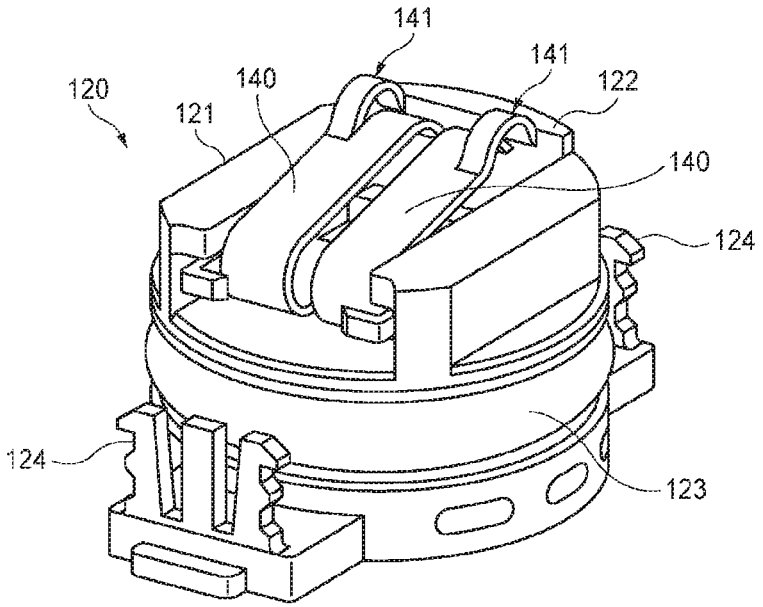
FIG. 2 is a perspective view illustrating a state where a short circuit terminal is mounted on a sub-housing of the connector illustrated in FIG. 1.

As illustrated in FIG. 2, the sub-housing 120 includes a retainer portion 121 which holds the plurality (two in the example) of short circuit terminals 140 having the same shape and the same dimension. In the retainer portion 121, a housing side locking portion 122 which is engaged with the terminal side locking portion 131 of the male terminal 130 stands in the fitting direction of the male housing 110. In a state where the sub-housing 120 is fitted to the male housing 110, as the housing side locking portion 122 extends to the inside of the recessed portion formed in the center portion in the longitudinal direction of the male terminal 130, even when a force is applied in a direction (rightward direction of FIG. 1) opposite to a coupling direction of the connector 1 to the male terminal 130, the terminal side locking portion 131 abuts against the housing side locking portion 122, and the male terminal 130 is inhibited from escaping from the male housing 110.

In an outer circumferential portion of the sub-housing 120, an annular sealing member 123 which tightly adheres to an inner surface of the fitting portion 115 of the male housing 110 is provided. In the sub-housing 120, a pair of locking claws 124 which are locked to be fitted to the pair of locking grooves 116 of the male housing 110 are formed.

Meanwhile, the female connector 200 includes a female housing 210 made of a synthetic resin. In the female housing 210, a plurality of female terminals 230 (only one of female terminals is illustrated, the same hereinafter) which correspond to the male terminal 130 of the male connector 100 are accommodated. The electric wire which is not illustrated is pressed to each of the female terminals 230. The female terminal 230 is mounted in the female housing 210 from an opening portion 210*a* of a rear end of the female housing 210 in a state where the electric wire is pressed.

The female housing 210 includes the insertion portion 211 inserted into the male housing 110, and an outer shell portion 212 into which a front end portion of the male housing 110 is inserted. The front end of the insertion portion 211 is open, and the opening portion 211*a* communicates with accommodation spaces of the plurality of female terminals 230. When the male connector 100 and the female connector 200 are coupled to each other, the plurality of male terminals 130 are inserted into the insertion portion 211, and are connected to the plurality of female terminals 230. An upper wall of the insertion portion 211 functions as a short circuit releasing member 213. In a circumferential edge portion of an opening portion 212*a* of the outer shell portion 212, a locking portion 214 which is engaged with the plurality of locking projections 114 of the male housing 110 is provided.

Figure 3:
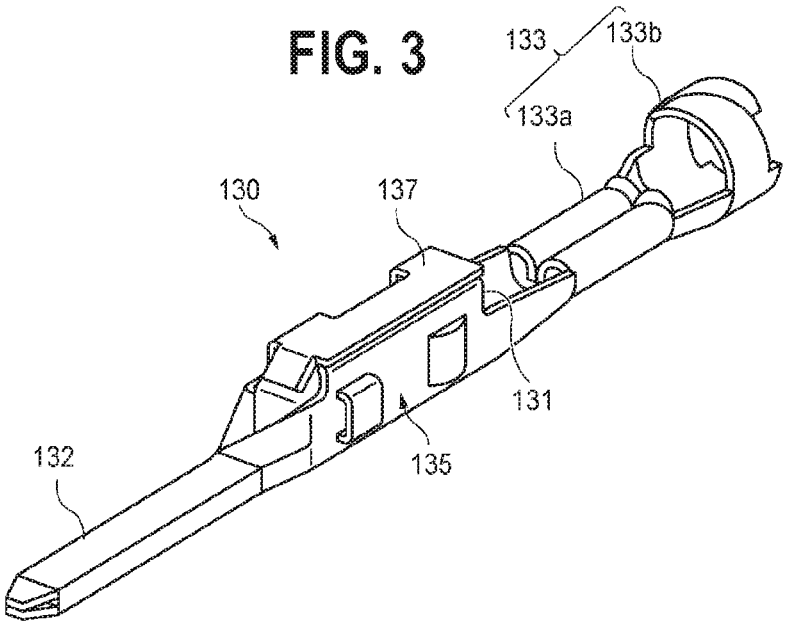
FIG. 3 is a perspective view of a male terminal illustrated in FIG. 1.

The male terminal 130 is manufactured by performing punching or bending processing with respect to a conductive plate made of metal, such as copper or copper alloy, into a predetermined shape. As illustrated in FIG. 3, on the tip end side of the male terminal 130, a tab-like electric connection portion 132 is formed, and on the rear end side, a pressing portion 133 to which the electric wire which is not illustrated is pressed and connected is formed. The tab-like electric connection portion 132 of the male terminal 130 protrudes to the terminal accommodation chamber 111, and can be connected to an electric connection portion 231 of the female terminal 230.

Between the electric connection portion 132 and the pressing portion 133, a terminal box portion 135 having a shape of a rectangular tube is formed. In addition, in the terminal box portion 135, a top surface 137 to which the elastic arm portion 141 of the short circuit terminal 140 is pressed is formed.

The pressing portion 133 is conducted and connected as an end portion of the electric wire of which the periphery of a conductor is covered with a sheath is pressed. The pressing portion 133 includes a conductor caulking portion 133*a* and a cover caulking portion 133*b*. The conductor caulking portion 133*a* is caulked to the conductor exposed from the sheath, and the cover caulking portion 133*b* is caulked to the sheath.

Figure 4:
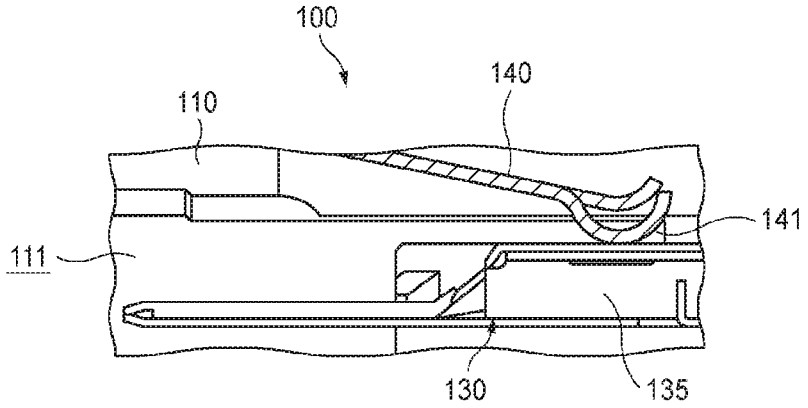
FIG. 4 is a sectional view of main portions illustrating a state where the male terminals of the connector illustrated in FIG. 1 are short-circuited by the short circuit terminal.
Figure 5:
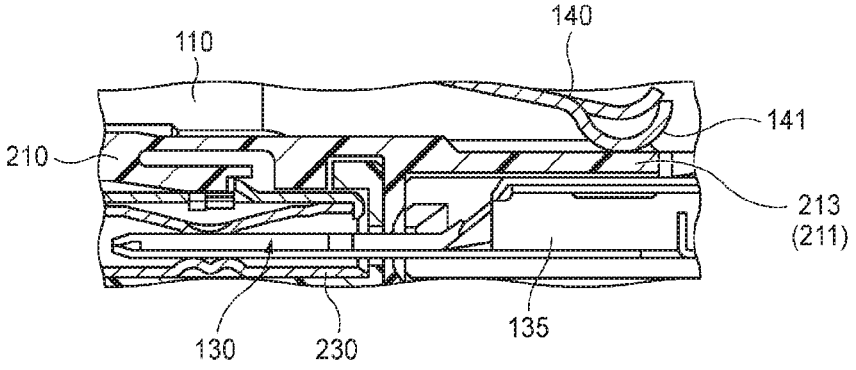
FIG. 5 is a sectional view of main portions illustrating a state where the state illustrated in FIG. 4 is released by a short circuit releasing member.

As illustrated in FIG. 4, in a state where the male connector 100 and the female connector 200 are not coupled to each other, the elastic arm portion 141 of the short circuit terminal 140 comes into contact with the terminal box portion 135 of at least two of the male terminals 130 of the male connector 100, and the male terminals 130 are short-circuited. From this state, when the coupling between the male connector 100 and the female connector 200 is started, the male terminal 130 is inserted into the female terminal 230. At this time, the short circuit releasing member 213 of the female connector 200 moves in a coupling direction while being in slidable contact with the elastic arm portion 141 of short circuit terminal 140. When the coupling between the male connector 100 and the female connector 200 is completed, an electric connection between the male terminal 130 and the female terminal 230 is completed. In addition, the locking projection 114 of the male housing 110 and the locking portion 214 of the female housing 210 are engaged with each other, the coupled state between the male connector 100 and the female connector 200 is maintained. At the same time, as illustrated in FIG. 5, as the short circuit releasing member 213 pushes up and elastically deforms the elastic arm portion 141, the elastic arm portion 141 is separated from the terminal box portion 135, and the short circuit between the male terminals 130 is released. Therefore, by sensing whether or not the short circuit between the male terminals 130 is released, it is possible to confirm that the male connector 100 and the female connector 200 are normally coupled to each other.

The connector 1 having the above-described configuration, in a state where the short circuit terminal 140 is mounted on the retainer portion 121 of the sub-housing 120 (FIG. 2), by allowing the sub-housing 120 to be fitted to the fitting portion 115 of the male housing 110, it is possible to mount the short circuit terminal 140 in the male housing 110.

The sub-housing 120 is assembled to the male housing 110 from the direction orthogonal to the fitting direction between the male connector 100 and the female connector 200. At this time, by allowing the pair of locking claws 124 of the sub-housing 120 and the pair of locking grooves 116 of the male housing 110 to be fitted to each other, and by assembling the sub-housing 120 to the male housing 110, the short circuit terminal 140 is mounted in an accurate posture at an accurate position to be capable of being in contact with the male terminal 130.

In this manner, since the connector 1 according to the embodiment has a configuration in which the sub-housing 120 is assembled to the male housing 110 from the direction orthogonal to the fitting direction between the male connector 100 and the female connector 200 in a state where the short circuit terminal 140 is mounted on the sub-housing 120, it is possible to set the dimension of the opening portion on the front end side of the male housing 110 to be smaller compared to the connector of the related art in which the short circuit terminal 140 is mounted from the opening portion 110*a* on the front end side of the male housing 110. In other words, even under the circumstance in which the dimension of the opening portion 110*a* is restricted, it is possible to mount the existing short circuit terminal 140 on the male housing 110. Accordingly, it becomes possible to use the existing short circuit terminal 140 in various connectors.

In addition, according to the above-described configuration, in a state where the plurality of male terminals 130 are accommodated in the plurality of terminal accommodation chambers 111 of the male housing 110, by assembling the sub-housing 120 to the male housing 110, the housing side locking portion 122 of the sub-housing 120 is engaged with the terminal side locking portion 131 of the plurality of male terminals 130 mounted on the male housing 110. As a result, the plurality of male terminals 130 are held in the male housing 110 not being removable.

In this manner, by employing a configuration in which the plurality of male terminals 130 are held in the male housing 110 by the sub-housing 120, it is not necessary to provide a holding portion (lance portion) having a complicated structure for holding the plurality of male terminals 130 in the male housing 110. Accordingly, it is possible to simplify the structure of the male housing 110, and to manufacture the male housing 110 at lower costs compared to that of the related art.

In addition, according to the configuration, since the annular sealing member 123 which tightly adheres to the inner surface of the fitting portion 115 of the male housing 110 is provided in the sub-housing 120, by assembling the sub-housing 120 to the male housing 110, the inside of the fitting portion 115 which communicates with the plurality of terminal accommodation chambers 111 is sealed. Accordingly, it is possible to prevent infiltration of moisture into the plurality of terminal accommodation chambers 111 from the fitting portion 115.

Second Embodiment

Next, a connector 2 in a second embodiment of the invention will be described.

Figure 6:
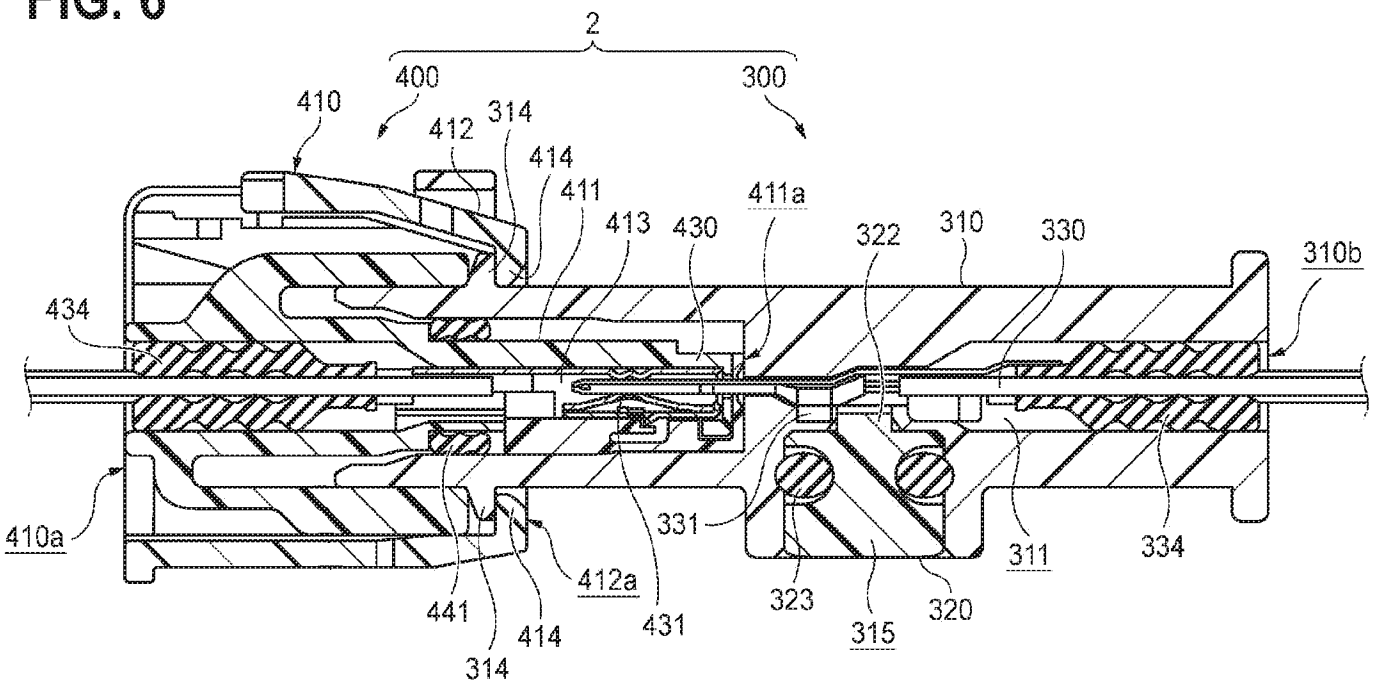
FIG. 6 is a sectional view illustrating a coupled state of connectors according to a second embodiment of the invention.
Figure 7:
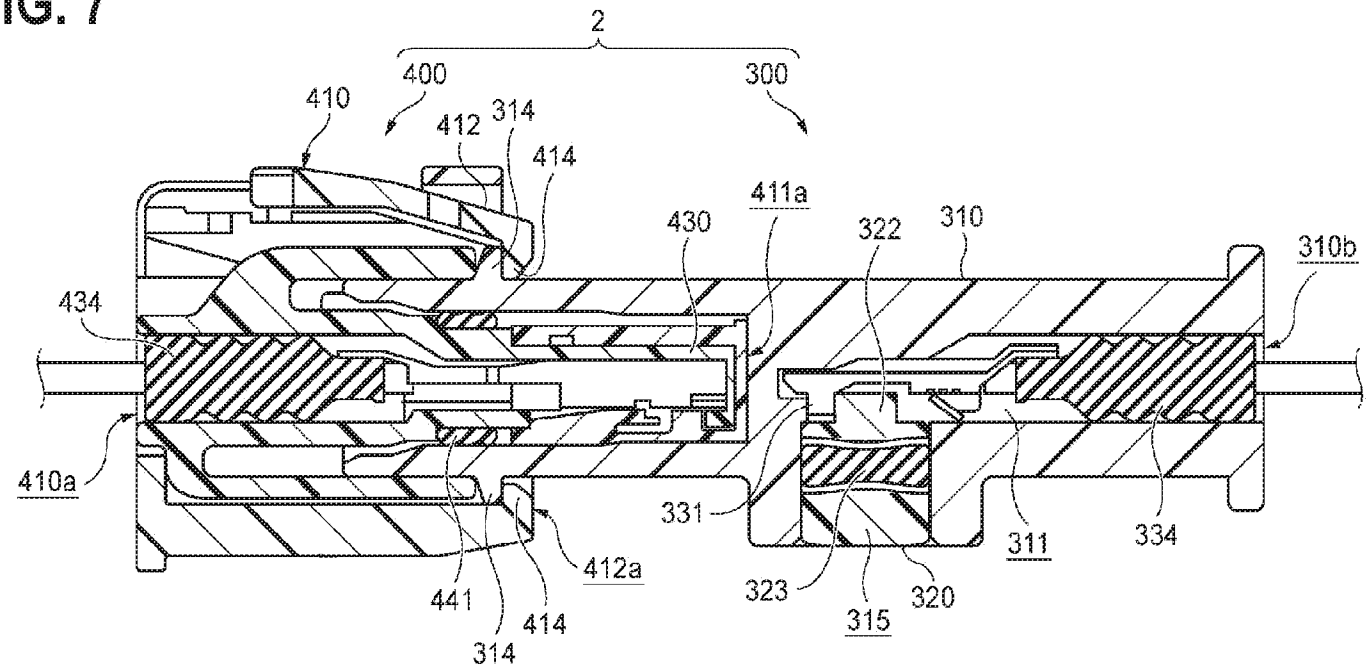
FIG. 7 is a sectional view illustrating the coupled state of the connectors according to the second embodiment of the invention.

FIGS. 6 and 7 are sectional views illustrating sections cut at a position at which the coupled state of the connector according to the second embodiment of the invention varies in parallel to each other. As illustrated in FIGS. 6 and 7, the connector 2 of the second embodiment includes a male connector 300 and a female connector 400 which can be engaged with each other.

The male connector 100 includes a male housing 310 made of a synthetic resin and a sub-housing 320 made of a synthetic resin.

Figure 8:
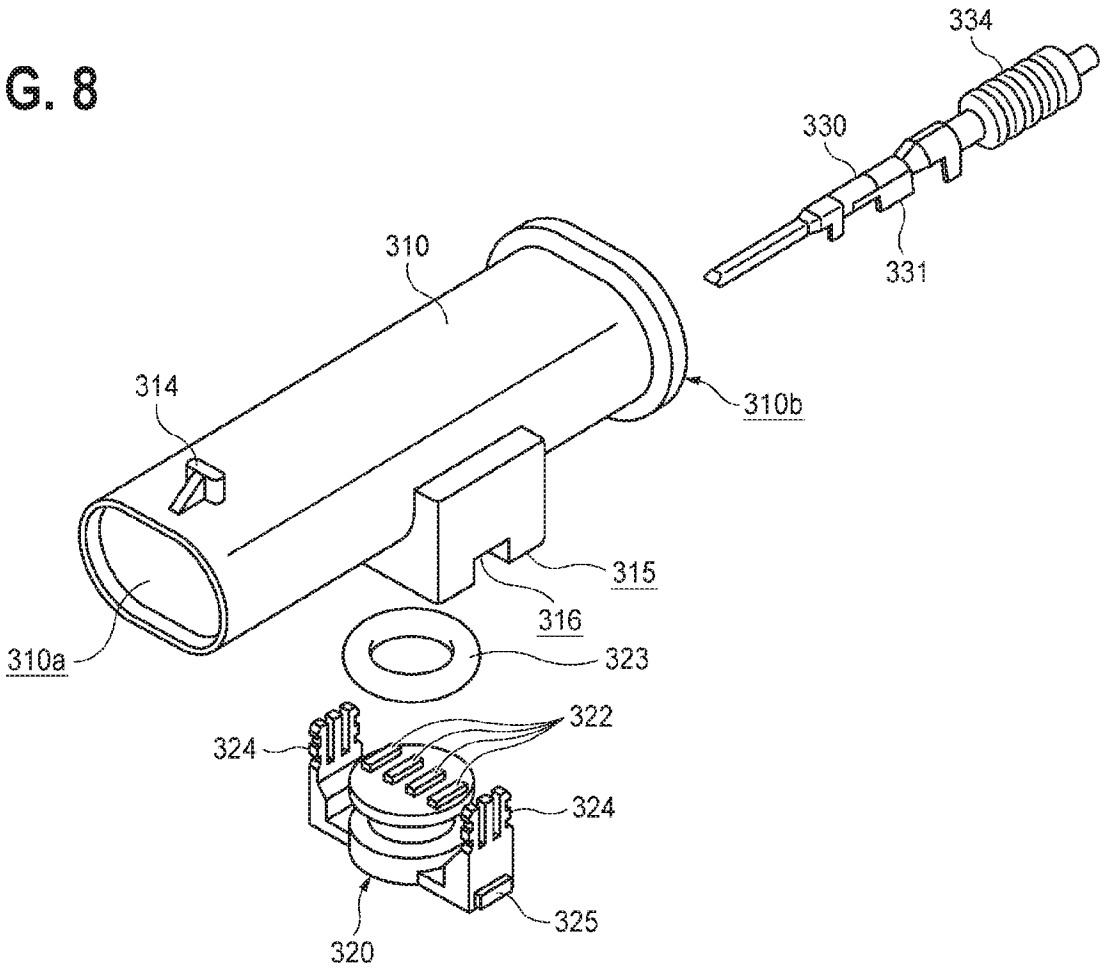
FIG. 8 is an exploded perspective view of a male connector of the connector illustrated in FIG. 6.

The male housing 310 includes an opening portion 310*a* (FIG. 8) and an opening portion 310*b* respectively on a front end side and on a rear end side. An insertion portion 411 of the female connector 400 is inserted into the opening portion 310*a* (FIG. 8) on the front end side. A plurality of locking projections 314 which are engaged with the female connector 400 are provided on an outer surface in the vicinity of the front end of the male housing 310.

In the male housing 310, a plurality of terminal accommodation chambers 311 (only one of the terminal accommodation chambers is illustrated, the same hereinafter) are formed. In each of the terminal accommodation chambers 311, male terminals 330 (only one of the male terminals is illustrated, the same hereinafter) are accommodated one by one.

Figure 9:
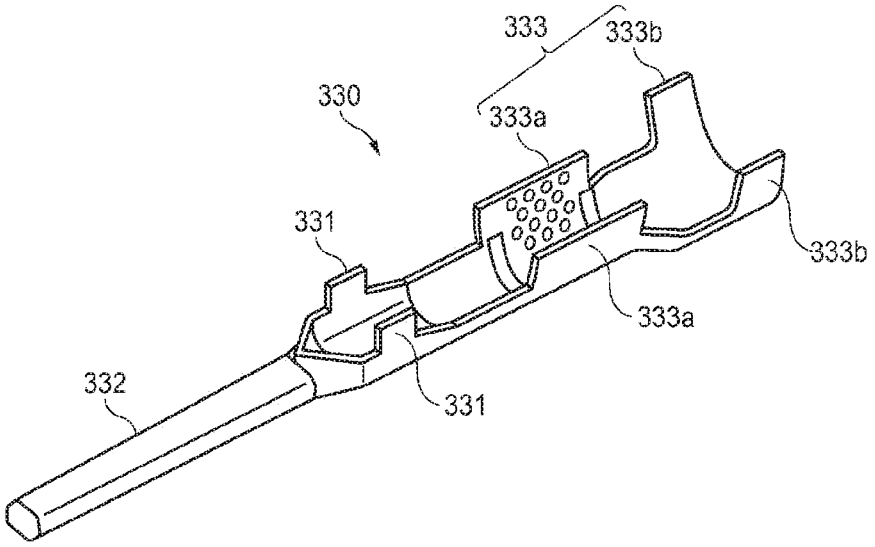
FIG. 9 is a perspective view of a male terminal of the connector illustrated in FIG. 6.
Figure 10:
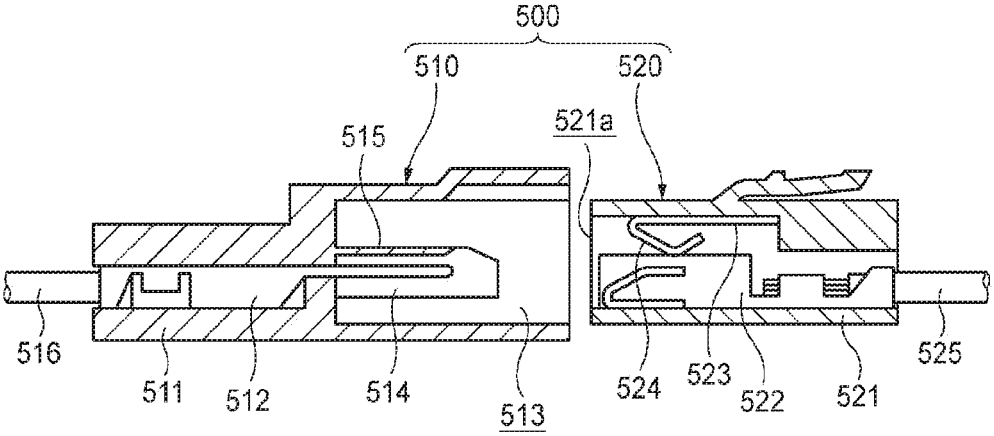
FIG. 10 Prior Art
FIG. 10 is a sectional view illustrating a non-coupled state of a connector of the related art.
Figure 11:
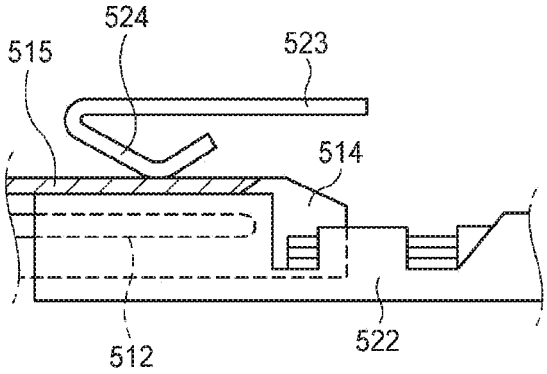
FIG. 11 Prior Art
FIG. 11 is a sectional view of main portions illustrating a state where female terminals of the connector illustrated in FIG. 10 are short-circuited by a short circuit terminal.

A male terminal 330 is manufactured by performing punching or bending processing with respect to a conductive plate made of metal, such as copper or copper alloy, into a predetermined shape. As illustrated in FIG. 9, on the tip end side of the male terminal 330, a tab-like electric connection portion 332 is formed, and on the rear end side, a pressing portion 333 to which the electric wire which is not illustrated is pressed and connected is formed. The tab-like electric connection portion 332 of the male terminal 330 protrudes to the terminal accommodation chamber 311, and can be connected to an electric connection portion 431 of the female terminal 430. The male terminal 330 is mounted in the terminal accommodation chamber 311 from the opening portion 310*b* on the rear end side in a state where the electric wire is pressed.

The pressing portion 333 is conducted and connected as an end portion of the electric wire of which the periphery of a conductor is covered with a sheath is pressed. The pressing portion 333 includes a conductor caulking portion 333*a* and a cover caulking portion 333*b*. The conductor caulking portion 333*a* is caulked to the conductor exposed from the sheath, and the cover caulking portion 333*b* is caulked to the sheath.

In the rear end portion of the male terminal 330, a sealing member 334 which tightly adheres to an inner wall of the terminal accommodation chamber 311 is provided. In the center portion in the longitudinal direction of the male terminal 330, terminal side locking portions 331 which are at front edges in a connector coupling direction of recessed portions formed in both side portions, are formed, and are engaged with the sub-housing 320. In the rear end portion of the male terminal 330, the pressing portion 333 which is pressed to the electric wire is formed.

The male housing 310 includes a tubular fitting portion 315 to which the sub-housing 320 is fitted. The inside of the fitting portion 315 communicates with the plurality of terminal accommodation chambers 311. The sub-housing 320 is fitted to the fitting portion 315 in the direction orthogonal to the fitting direction between the male connector 300 and the female connector 400. At the opening edge of the fitting portion 315, a pair of left and right first fitting grooves 316 are provided.

In the sub-housing 320, two pairs of housing side locking portions 322 which are engaged with the terminal side locking portion 331 of the male terminal 330, and each pair of housing side locking portions 322 respectively lock the terminal side locking portions 331 of both side portions of one of the male terminals 330.

In an outer circumferential portion of the sub-housing 320, an annular sealing member 323 which tightly adheres to an inner surface of the fitting portion 315 in a state where the sub-housing 320 is fitted to the male housing 310 is provided. In the sub-housing 320, a pair of left and right locking claws 324 which are locked to the inner wall of the fitting portion 315, and a pair of left and right projection portions 325 which are fitted to the pair of left and right fitting grooves 316 of the fitting portion 315, are provided.

Meanwhile, the female connector 400 includes a female housing 410 made of a synthetic resin. In the female housing 410, a plurality of female terminals 430 (only one of the female terminals is illustrated, the same hereinafter) which correspond to the male terminal 330 of the male connector 300 are accommodated. Each of the female terminals 430 is accommodated in the terminal accommodation chamber 413 one by one. The electric wire which is not illustrated is pressed to each of the female terminals 430. The female terminal 430 is mounted in the female housing 410 from an opening portion 410*a* of the rear end of the female housing 410 in a state where the electric wire is pressed. In the rear end portion of the female terminal 430, a sealing member 434 which tightly adheres to the inner wall of a terminal accommodation chamber 413 is provided.

The female housing 410 includes the insertion portion 411 which is inserted into the male housing 310, and an outer shell portion 412 into which the male housing 310 is inserted. The front end of the insertion portion 411 is open, and the opening portion 411*a* communicates with the terminal accommodation chamber 413. When the male connector 300 and the female connector 400 are coupled to each other, the plurality of male terminals 330 are inserted into the insertion portion 411, and are connected to the plurality of female terminals 430. In a base portion of the insertion portion 411, a sealing member 441 which tightly adheres to the inner wall of the front end portion of the male housing 310 is provided. In a circumferential edge portion of an opening portion 412*a* of the outer shell portion 412, a locking portion 414 which is engaged with the plurality of locking projections 314 of the male housing 310 is provided.

As described above, in the connector 2 of the second embodiment, a part between the male housing 310 and the sub-housing 320, a part between the male housing 310 and the male terminal 330, and a part between the female housing 410 and the female terminal 430 are respectively sealed by the sealing members 323, 334, and 434. In addition, when the male connector 300 and the female connector 400 are coupled to each other, the part between the male housing 310 and the female housing 410 is sealed by the sealing member 441. Therefore, by coupling the male connector 300 and the female connector 400 to each other, a complete water tight structure is realized, and infiltration of moisture into the terminal accommodation chamber 311 of the male connector 300 and the terminal accommodation chamber 413 of the female connector 400 is prevented.

In addition, according to the configuration, in a state where the plurality of male terminals 330 are accommodated in the plurality of terminal accommodation chambers 311 of the male housing 310, by assembling the sub-housing 320 to the male housing 310, the housing side locking portion 322 of the sub-housing 320 is engaged with the terminal side locking portion 331 of the plurality of male terminals 330 mounted on the male housing 310. As a result, the plurality of male terminals 330 are held in the male housing 310 not being removable.

In this manner, by employing a configuration in which the plurality of male terminals 330 are held in the male housing 310 by the sub-housing 320, it is not necessary to provide the holding portion (lance portion) having a complicated structure for holding the plurality of male terminals 330 in the male housing 310. Accordingly, it is possible to simplify the structure of the male housing 310, and to manufacture the male housing 310 at lower costs compared to that of the related art.

In addition, the invention is not limited to the above-described embodiment, and various modification examples can be employed within the range of the invention. For example, the invention is not limited to the above-described embodiments, and can be appropriately deformed or improved. In addition, the materials, the shape, the dimension, the number, the disposition location or the like of each of the configuration elements in the above-described embodiments are arbitrary as long as the invention can be achieved, and are not limited.

For example, in the above-described example, a configuration in which the male terminal 330 is held by the sub-housing 320 assembled to the male housing 310 is employed, but a configuration similar thereto may also be employed on the female housing 410, and by assembling the sub-housing to the female housing 410, the plurality of female terminals 430 may be held by the sub-housing. Then, it is not necessary to provide the holding portion (lance portion) having a complicated structure for holding the plurality of female terminals 430 in the female housing 410. Accordingly, it is possible to simplify the structure of the female housing 410, and to manufacture the female housing 410 at lower costs compared to that of the related art.

In addition, in the sub-housing 320 of the second embodiment, similar to the first embodiment, the retainer portion which holds the short circuit terminal 140 may be provided.

Here, characteristics of the connector of the above-described embodiment according to the present invention are respectively briefly summarized and listed in the following [1] to [4].

[1] A connector (1 and 2) including: a connector housing (male housings 110 and 310) which includes a plurality of terminal accommodation chambers (111 and 311); a terminal (male terminals 130 and 330) which is accommodated in the terminal accommodation chamber; a retainer portion (121) which holds the accommodated terminal in the terminal accommodation chamber; a short circuit terminal (140) which makes at least two of the accommodated terminals be in a short-circuited state by coming into contact with the two accommodated terminals; and a sub-housing (120 and 320) on which the short circuit terminal is mounted, in which the connector housing includes a fitting portion (115 and 315) which is open to the terminal accommodation chamber and to which the sub-housing is fitted in a direction orthogonal to a fitting direction between the connector housing and a counterpart connector housing (female housings 210 and 410), and, in the sub-housing, in a state where the sub-housing is fitted to the connector housing, the retainer portion is formed at a position of holding the terminal and the short circuit terminal is mounted at a position at which the short circuit terminal comes into contact with at least two of the terminals.

[2] The connector according to the above-described [1], in the counterpart connector housing, in a state of being fitted to the connector housing, a short circuit releasing member (213) which releases the short-circuited state by coming into contact with the short circuit terminal and deforming the short circuit terminal is formed.

[3] The connector according to the above-described [1] or [2], the sub-housing includes a sealing member (123 and 323) which tightly adheres to an inner wall of the fitting portion in a state of being mounted at an outer circumference and fitted to the fitting portion.

[4] The connector according to any of the above-described [1] to [3], the retainer portion and the terminal respectively include a locking portion (the housing side locking portion 122 and the terminal side locking portion 131), and, in a state where the sub-housing is fitted to the connector housing, the locking portion of the retainer portion and the locking portion of the terminal are locked to each other.

What is claimed is:

1. A connector comprising:

a connector housing that includes a plurality of terminal accommodation chambers;

a terminal that is accommodated in the terminal accommodation chamber;

a retainer portion that holds the accommodated terminal in the terminal accommodation chamber;

a short circuit terminal that makes at least two of the accommodated terminals be in a short-circuited state by coming into contact with the two accommodated terminals; and a sub-housing on which the short circuit terminal is mounted, wherein the connector housing includes a fitting portion which is open to the terminal accommodation chamber and to which the sub-housing is fitted in a direction orthogonal to a fitting direction of the connector housing to a counterpart connector housing, and in the sub-housing, in a state where the sub-housing is fitted to the connector housing, the retainer portion is formed at a position of holding the terminal and the short circuit terminal is mounted at a position at which the short circuit terminal comes into contact with at least two of the terminals.

2. The connector according to claim 1, wherein, in the counterpart connector housing, in a state of being fitted to the connector housing, a short circuit releasing member which releases the short-circuited state by coming into contact with the short circuit terminal and deforming the short circuit terminal is formed.

3. The connector according to claim 1, wherein the sub-housing includes a sealing member which tightly adheres to an inner wall of the fitting portion in a state of being mounted on an outer circumference of the sub-housing and fitted to the fitting portion.

4. The connector according to claim 1, wherein the retainer portion and the terminal respectively include a locking portion, and in a state where the sub-housing is fitted to the connector housing, the locking portion of the retainer portion and the locking portion of the terminal are locked to each other.

* * * * *